US006586610B2

(12) United States Patent
Ulrich

(10) Patent No.: US 6,586,610 B2
(45) Date of Patent: Jul. 1, 2003

(54) METHOD FOR REMOVING COUMAFOS FROM BEESWAX

(75) Inventor: Dieter Ulrich, Leverkusen (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 10/135,286

(22) Filed: Apr. 30, 2002

(65) Prior Publication Data

US 2002/0174803 A1 Nov. 28, 2002

(30) Foreign Application Priority Data

May 25, 2001 (DE) ..... 101 25 431

(51) Int. Cl.[7] ..... C11B 3/10
(52) U.S. Cl. ..... 554/191
(58) Field of Search ..... 554/191

(56) References Cited

FOREIGN PATENT DOCUMENTS

| | | |
|---|---|---|
| GB | 665157 | 1/1952 |
| GB | 671113 | 4/1952 |

OTHER PUBLICATIONS

JAPIO abstr. of JP–02142897, AN—1990–142897, May 1990.*

"Bestimmung von Brompropylat, 4,4'–Dibrombenzophenon, Coumaphos und Fluvalinant in Bienwenwachs"—Heft 11, 1993.

"Comparison of the transfer of coumaphos from beeswax into syrup and honey"—Jan Kochansky, et al., USDA ARS Bee Research Laboratory, Beltsville, MD, Nov. 7, 2000.

"8.3 Candle Filters, 8.5 Disk Filters"—(Filtration, Filtration Equipment)—Ullmann's Encyclopedia of Industrial Chemistry, Sixth Edition, 2002 Electronic Release.

"Die Varroatose der Honigbiene, Apis mellifera, und ihre Bekämpfung mit Perizin"—W. Ritter, Veterinär–Medizinische Nachrichten, vol. 1, p. 3; G. Elwert; Tierhygienisches Institut Freiburg, 1986.

* cited by examiner

*Primary Examiner*—Deborah D. Carr
(74) *Attorney, Agent, or Firm*—Norris McLaughlin & Marcus

(57) ABSTRACT

A method is for removing coumafos (O,O'-diethyl-O"-(3-chloro-4-methyl-7-coumarinyl)thiophosphate) from beeswax by melting the beeswax, adding activated charcoal to the melted beeswax to form a suspension of the activated charcoal in the melted beeswax, and adsorbing coumafos from the melted beeswax onto the activated charcoal, and then pressure filtering.

6 Claims, No Drawings

METHOD FOR REMOVING COUMAFOS FROM BEESWAX

The invention pertains to a method for removing coumafos (O,O'-diethyl-O"-(3-chloro-4-methyl-7-coumarinyl) thiophosphate) from beeswax by adsorption onto activated charcoal followed by pressure filtration.

BACKGROUND OF THE INVENTION

The mite Varroa jacobsoni causes the parasitic disease of honeybees known as varroatosis. The mite parasitizes the adult bees and their brood phases. After a latency period of several years, during which no clinical symptoms are observed, the colonies collapse within a short time. Early diagnosis is of decisive importance for successful therapy. Perizin® was developed by Bayer AG together with the Tierhygienisches Institut Freiburg [Department of Animal Hygiene Freiburg] for the diagnosis and therapy of varroatosis via drugs. W. Ritter, Tierhygienisches Institut Freiburg; "Die Varroatose der Honigbiene, Apis mellifera, und ihre Bekämpfung mit Perizin®" [Varroatosis of the honeybee, Apis mellifera, and its control with Perizin®], Veterinär-Medizinische Nachrichten, Volume 1, p. 3; G. Elwert Universitäts-und Verlagsbuchhandlung Marburg-Lahn; 1986.

When a mite-infested bee colony is treated with Perizin, the active ingredient coumafos is spread throughout the beehive owing to the shared metabolism during social feeding. After a certain duration of action, the active ingredient is biodegraded slowly. However, any coumafos which reaches the honeycomb wax can be enclosed and preserved therein. Being the raw material for what is known as the foundations, the basal sheets on which the bees re-establish new cells, beeswax is constantly recycled. Existing analytical results suggest that enclosed coumafos is concentrated to over 20 ppm as the wax is recycled; however, even a load of 5 ppm is considered as unacceptable. It is therefore necessary to eliminate the active ingredient at a point of the cycle between apiarist and foundation manufacturer by isolating it from the wax and disposing of it; the point of the cycle is yet to be established.

SUMMARY OF THE INVENTION

The invention pertains to a method for removing coumafos from beeswax by adsorption onto activated charcoal followed by pressure filtration, by:

a) melting the beeswax, b) adding pulverulent activated charcoal in an amount of at least 5 g per litre of liquid wax, c) preparing a homogeneous suspension of the mixture, d) maintaining the suspension over a specific contact period, e) filtering of the suspension in a pressure filter at a pressure differential at the filter medium of at least 1 bar.

DETAILED DESCRIPTION

In a preferred variant of the method according to the invention, the activated charcoal is brought into contact with the beeswax for at least 5 minutes prior to filtration.

The pressure differential in the filtration step is advantageously 4 to 6 bar. Owing to the low solids concentration and the comparably small particle size, the present object of the filtration can be termed a clarifying filtration. Suitable pressure filters with sufficiently large filter surfaces are, for example, disc pressure filters or candle filters. Both are closed discontinuous apparatuses for clarifying filtration with adjustable pressure differential and automated cake removal. Owing to the compact arrangement of the disc- or candle-shaped filter elements within the pressure filters, filter surfaces of over 100 $m^2$ can be achieved. Such pressure filters are described, for example, in Ullmann's Encyclopaedia of Industrial Chemistry, Sixth Edition, WILEY-VCH, Electronic Release 2001; Filtration, 8. Filtration Equipment, 8.3 Candle Filters and 8.5 Disk Filters.

The amount of activated charcoal is preferably 20 to 50 g per litre of melted wax. The activated charcoal employed should have as high an adsorption capacity and as good filtration properties as possible. Adsorption capacity and filtration properties of the activated charcoal are adjusted during production by the type of activation and the formulation. The activated charcoal CA 1®, which is manufactured by Norit, has proved to be particularly suitable.

The contact time between activated charcoal and beeswax is preferably 30 to 90 minutes.

In an especially preferred variant of the method according to the invention, the suspension is stirred during the contact time in order to avoid settling of the activated charcoal at the container bottom. Sedimentation of the activated charcoal would lead to the separation of activated charcoal and beeswax. Owing to the probability of contact between active ingredient and adsorbent, it can be expected that a lesser amount of coumafos can be adsorbed when the activated charcoal is distributed unevenly in the suspension compared with the same amount of activated charcoal when distributed evenly.

When the method according to the invention is applied, coumafos is removed efficiently from beeswax.

EXAMPLE 1

According to the Invention

Coumafos can be removed from beeswax on an industrial scale for example as follows:

a) 2000 kg of beeswax are melted in a heated stirred vessel with a nominal volume of 4 $m^3$ at a temperature of 80° C.

b) 100 kg of activated charcoal are added with stirring.

c) Stirring is then continued at a temperature of 80° C. for 1 hour.

d) The suspension is then filtered at a filtration pressure of 4 to 6 bar. A filtration apparatus which can be employed is a heated disc pressure filter with automated cake removal. An apparatus with a filter surface of approximately 10 $m^2$ suffices for decontaminating 2000 kg of wax.

The overall cycle time for the batchwise processing of 2000 kg of wax is approximately 4 hours, so that a system throughput of approximately 500 kg/h results. Each tonne of processed wax leads to residues in an order of magnitude of 100 kg, which must be disposed of. Owing to the high calorific value of the filter cake, incineration of the residues is a convenient method of disposal.

EXAMPLE 2

According to the Invention

Laboratory experiment for removing coumafos from beeswax.

First, 2000 ml of beeswax were melted in a water bath at a temperature of 80° C. The density of the wax at 80° C. and ambient pressure was $\rho$=0.824 kg/m$^3$ and the dynamic viscosity $\eta$=14 mPas. Then, 50 g of pulverulent activated charcoal type CA 1®, manufactured by Norit, were added to each litre of melted wax and the mixture was stirred at 80° C. for a contact time of 60 minutes. The suspension was subsequently filtered in a heated laboratory pressure filter with a filter surface of 100 cm$^2$ and a filtration pressure of 5.75 bar. The filtration time was 8 minutes, and the subsequent time for mechanical drying, where the filter cake was exposed to a stream of pressurized air, was a further 10 minutes. The cake height at the end of the experiment amounted to 30 mm and the weight of the filter cake to 207.7 g. The treatment succeeded in reducing the coumafos level from approximately 20 ppm to less than 1 ppm.

EXAMPLE 3

Comparative Example

When using activated-charcoal-containing filter layers for removing coumafos from beeswax by filtration instead of by adding pulverulent activated charcoal, no reduction of the coumafos level based on the initial value of approximately 20 ppm was observed. The activated charcoal content of the filter layer used amounted to 1.4 g for manufacturing reasons, and 1500 ml of beeswax were filtered in approximately 3 hours. The use of activated-charcoal-containing filter layers did not lead to a removal of coumafos from beeswax.

EXAMPLE 4

Addition of 2 g/l pulverulent activated charcoal to melted beeswax followed by filtration did not lead to a measurable reduction in the coumafos content, which was approximately 20 ppm.

Example according to the invention:

Only by addition of at least 20 g/l activated charcoal to the liquid beeswax was it possible to reduce the coumafos content to less than 5 ppm.

EXAMPLE 5

Serial experiments in which the contact time between activated charcoal and beeswax varied between 15 and 120 minutes have demonstrated that the reduction in the coumafos content can be improved considerably by a longer contact time. After approximately 60 minutes, however, this effect gradually becomes less pronounced, so that only minor improvements in removal can be expected from a contact time of 120 minutes and up.

Example according to the invention:

The procedure was as in Example 1, but the contact time amounted to 15 minutes. Increasing the residence time from 15 minutes to 60 minutes resulted in a further reduction from approximately 5 ppm to less than 1 ppm. In contrast, filtration of the suspension immediately after briefly distributing the powdered charcoal leads to virtually no measurable reduction in the coumafos content in the beeswax, which was approximately 20 ppm.

I claim:

1. Method for removing coumafos (O,O'-diethyl-O"-(3-chloro-4-methyl-7-coumarinyl)thiophosphate) from beeswax by adsorption onto activated charcoal followed by pressure filtration, which comprises:

a) melting the beeswax, b) adding pulverulent activated charcoal to the melted beeswax in an amount of at least 5 g per litre of melted beeswax, c) preparing a homogeneous suspension of the mixture, d) maintaining the suspension for a period of time sufficient to adsorb coumafos from the beeswax onto the charcoal, e) filtering of the suspension in a pressure filter at a pressure differential across the filter medium of at least 1 bar.

2. Method according to claim 1, wherein the suspension is maintained for at least 5 minutes prior to filtration.

3. Method according to claim 2, wherein the suspension is maintained for from 30 to 60 minutes.

4. Method according to claim 1, wherein the pressure differential across the filter medium is 4 to 6 bar.

5. Method according to claim 1, wherein the amount of activated charcoal amounts to 20 to 50 g per litre of melted beeswax.

6. Method according to claim 1, wherein the suspension is maintained with stirring.

* * * * *